US008254589B2

(12) United States Patent
Mitsuhata

(10) Patent No.: US 8,254,589 B2
(45) Date of Patent: Aug. 28, 2012

(54) ACTIVE NOISE SUPPRESSOR

(75) Inventor: Shinsuke Mitsuhata, Moriya (JP)

(73) Assignee: Asahi Group Holdings, Ltd., Tokyo (JP)

( * ) Notice: Subject to any disclaimer, the term of this patent is extended or adjusted under 35 U.S.C. 154(b) by 1152 days.

(21) Appl. No.: 11/978,200

(22) Filed: Oct. 26, 2007

(65) Prior Publication Data

US 2008/0118083 A1 May 22, 2008

Related U.S. Application Data

(63) Continuation of application No. PCT/JP2006/302652, filed on Feb. 15, 2006.

(30) Foreign Application Priority Data

Apr. 27, 2005 (JP) ..... 2005-130412

(51) Int. Cl.
*G10K 11/16* (2006.01)

(52) U.S. Cl. ..... 381/71.11; 381/71.1

(58) Field of Classification Search ..... 381/71.1, 381/71.8, 71.9, 71.12, 71.14, 98, 71.11, 97; 71/71.1, 71.8, 71.9, 71.12, 71.14, 98
See application file for complete search history.

(56) References Cited

U.S. PATENT DOCUMENTS 4,566,118 A * 1/1986 Chaplin et al. ..... 381/71.9
4,878,188 A * 10/1989 Ziegler, Jr. ..... 708/300
5,293,578 A * 3/1994 Nagami et al. ..... 381/71.14
5,319,715 A * 6/1994 Nagami et al. ..... 381/71.14
6,351,664 B1 * 2/2002 Brodnick ..... 600/509

FOREIGN PATENT DOCUMENTS

| | | |
|---|---|---|
| JP | 8-339191 | 12/1996 |
| JP | 9-297585 | 11/1997 |
| JP | 11-325168 | 11/1999 |
| JP | 2004-46150 | 2/2004 |
| JP | 2004-361721 | 12/2004 |

OTHER PUBLICATIONS

PCT Notification of Transmittal of Translation of the International Preliminary Report on Patentability, International Preliminary Report on Patentability and Written Opinion of the ISA mailed Nov. 8, 2007.
International Search Report dated May 16, 2006 (PCT/JP2006/302652).

* cited by examiner

*Primary Examiner* — Vivian Chin
*Assistant Examiner* — Andrew Graham
(74) *Attorney, Agent, or Firm* — Milbank Tweed Hadley & McCloy LLP

(57) ABSTRACT

A noise suppressor includes a fundamental sound source (121, 122) for generating a fundamental waveform having a predetermined frequency, and suppresses that frequency component of noise which corresponds to the predetermined frequency by generating a control sound from a signal generated by multiplying the fundamental waveform by an adaptive filter coefficient (W0, W1). The noise suppressor further includes a frequency adjusting circuit (210) for increasing or decreasing, by a predetermined amount, the frequency of the fundamental waveform output from the sound source if the phase fluctuation of the control sound detected by using the adaptive filter coefficient is larger than a predetermined threshold value. The noise suppressor has improved ability of tracking the peak frequency fluctuation of periodic noise.

7 Claims, 10 Drawing Sheets

WHEN NOISE WAS SUPPRESSED (WITHOUT FREQUENCY ADJUSTMENT)

WHEN NOISE WAS SUPPRESSED (WITH FREQUENCY ADJUSTMENT)

ACTIVE NOISE SUPPRESSOR

CROSS-REFERENCE TO RELATED APPLICATION

This is a continuation of International Application PCT/JP 2006/302652, with an international filing date of Feb. 15, 2006, which in turn claims priority to Japanese Patent Application No. 2005-130412, with a filing date of Apr. 27, 2005; the entirety of the disclosures of those applications are incorporated by reference herein.

TECHNICAL FIELD

The present invention relates to an active noise suppressor that suppresses periodic noise by installing a control sound source near an apparatus that produces the noise and, more particularly, to control the tracking of fluctuations in noise frequency.

BACKGROUND ART

Conventionally, active noise control (ANC) conventionally is known as a technique that suppresses periodic noise such as the operating sound of a motor or engine. The ANC technique generates a signal (control sound) having the same amplitude as that of noise and a phase opposite to that of the noise, and reduces the noise by sound wave interference. The ANC technique is used, for example, to reduce the noise in car cabins and reduce the effect of environmental noise when using headphones.

As a method of generating the control sound, a method that applies an adaptive notch filter to a sine wave and cosine wave output from a fundamental sound source and synthesizes a signal after adaptation is known. FIG. 1 is a view showing an example of the arrangement of an active noise suppressor using the adaptive notch filter.

This active noise suppressor comprises an adaptive notch filter 100, a cosine wave generator 121 and sine wave generator 122 forming a fundamental sound source, transfer elements 101 and 102 that respectively apply transfer functions C0 and C1 of a premeasured system to the output frequency of the fundamental sound source, an adder 103 that adds the outputs from the transfer elements 101 and 102 and outputs the sum as a reference signal r, and an adaptive control algorithm calculator (filter coefficient calculator) 110.

The cosine wave generator 121 and sine wave generator 122 respectively output a cosine wave signal and sine wave signal having a frequency equal to a peak frequency f of premeasured noise, and having a predetermined amplitude. These fundamental signals are supplied to the transfer elements 101 and 102 that respectively apply the transfer coefficients C0 and C1 premeasured for a signal having the frequency f, and to the adaptive notch filter 100.

The adaptive notch filter 100 multiplies the cosine wave and sine wave signals by filter coefficients W0 and W1, respectively, supplied from the adaptive control algorithm calculator 110, and outputs the signals. An adder 130 adds the output signals from the adaptive notch filter 100, and the obtained signal is output as a control sound from, for example, a loudspeaker (not shown).

The adaptive algorithm calculator 110 receives an error signal e (a difference between the control signal and target noise) obtained by a microphone 140 and the reference signal r output from the adder 103, and calculates and updates the coefficients W0 and W1 of the notch filter 100 by an adaptive algorithm such as an LMS (Least Mean Square) algorithm so as to reduce the error signal e.

Patent Reference 1: Japanese Patent Laid-Open No. 11-325168

DISCLOSURE OF INVENTION

Problems that the Invention is to Solve

To obtain a favorable noise suppressing effect, it is necessary to effectively suppress the peak frequency component of noise. Therefore, to control a noise source such as an automobile engine that changes its peak frequency component in accordance with the engine revolution, appropriate filter coefficients W0 and W1 must be calculated for each of the engine revolutions. Since the engine revolution constantly changes, however, a processor capable of high-speed operations is required to obtain appropriate filter coefficients in real time, and this raises the cost of the active noise suppressor.

Accordingly, Patent Reference 1, for example, has proposed an arrangement that uses, instead of the adaptive algorithm calculator 110, a ROM storing filter coefficients precalculated for individual engine revolution, and uses a coefficient read out from an address corresponding to the engine revolution.

Although this arrangement can implement a high-speed, low-cost active noise suppressor, the filter coefficients W0 and W1 must be precalculated. In addition, the frequency component of noise changes from one environment to another, so no satisfactory effect can be obtained if the same filter coefficient is applied to another environment. In the case of an automobile, therefore, the filter coefficients W0 and W1 corresponding to the engine revolutions must be precalculated for each combination of an engine type and automobile type, and this requires much labor and time. Also, this arrangement lacks flexibility because it cannot immediately adapt to a new environment.

The present invention has been made in consideration of the problems of the conventional techniques as described above, and has as its object to provide an active noise suppressor having improved ability of tracking the peak frequency fluctuation of periodic noise.

It is another object of the present invention to provide a versatile active noise suppressor.

Means of Solving the Problems

The above objects are achieved by an active noise suppressor having a fundamental sound source which generates a fundamental waveform having a predetermined frequency, and suppresses a frequency component of noise which corresponds to the predetermined frequency by generating a control sound from a signal obtained by multiplying the fundamental waveform by an adaptive filter coefficient, comprising: phase detecting means for detecting a phase of the control sound by using the adaptive filter coefficient, change amount detecting means for detecting a change amount of the phase of the control sound, and frequency adjusting means for increasing or decreasing, by a predetermined amount, the frequency of the fundamental waveform output from the fundamental sound source, if the change amount of the phase of the control sound is larger than a predetermined threshold value.

Effects of the Invention

With this arrangement, the present invention can implement active noise suppressor capable of closely tracking the peak frequency fluctuation of periodic noise by a simple arrangement.

BEST MODE FOR CARRYING OUT THE INVENTION

A preferred embodiment of the present invention will be explained in detail below with reference to the accompanying drawings.

Figure 1:
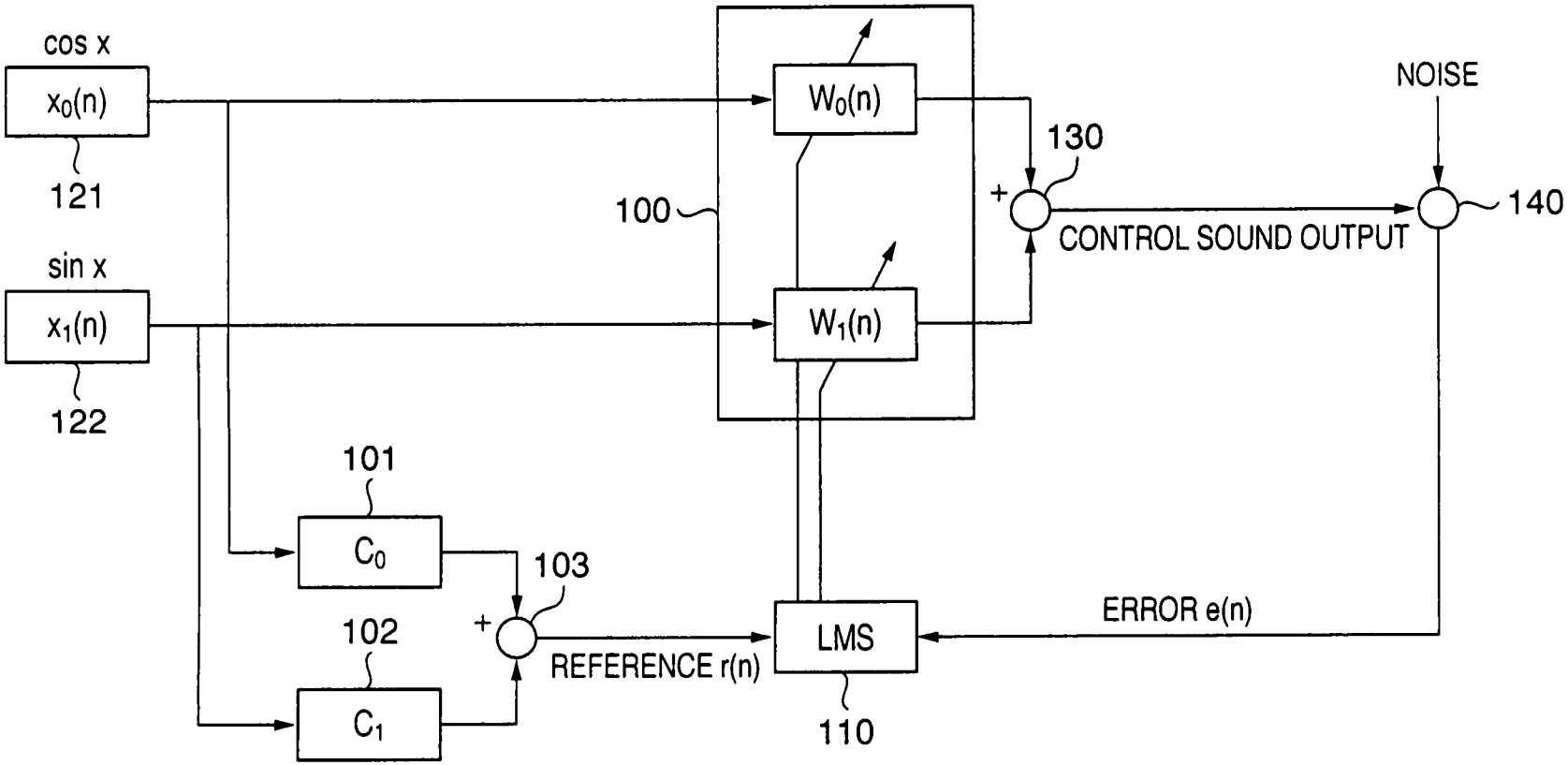
FIG. 1 PRIOR ART
FIG. 1 is a block diagram showing an example of the arrangement of a conventional active noise suppressor.
Figure 2:
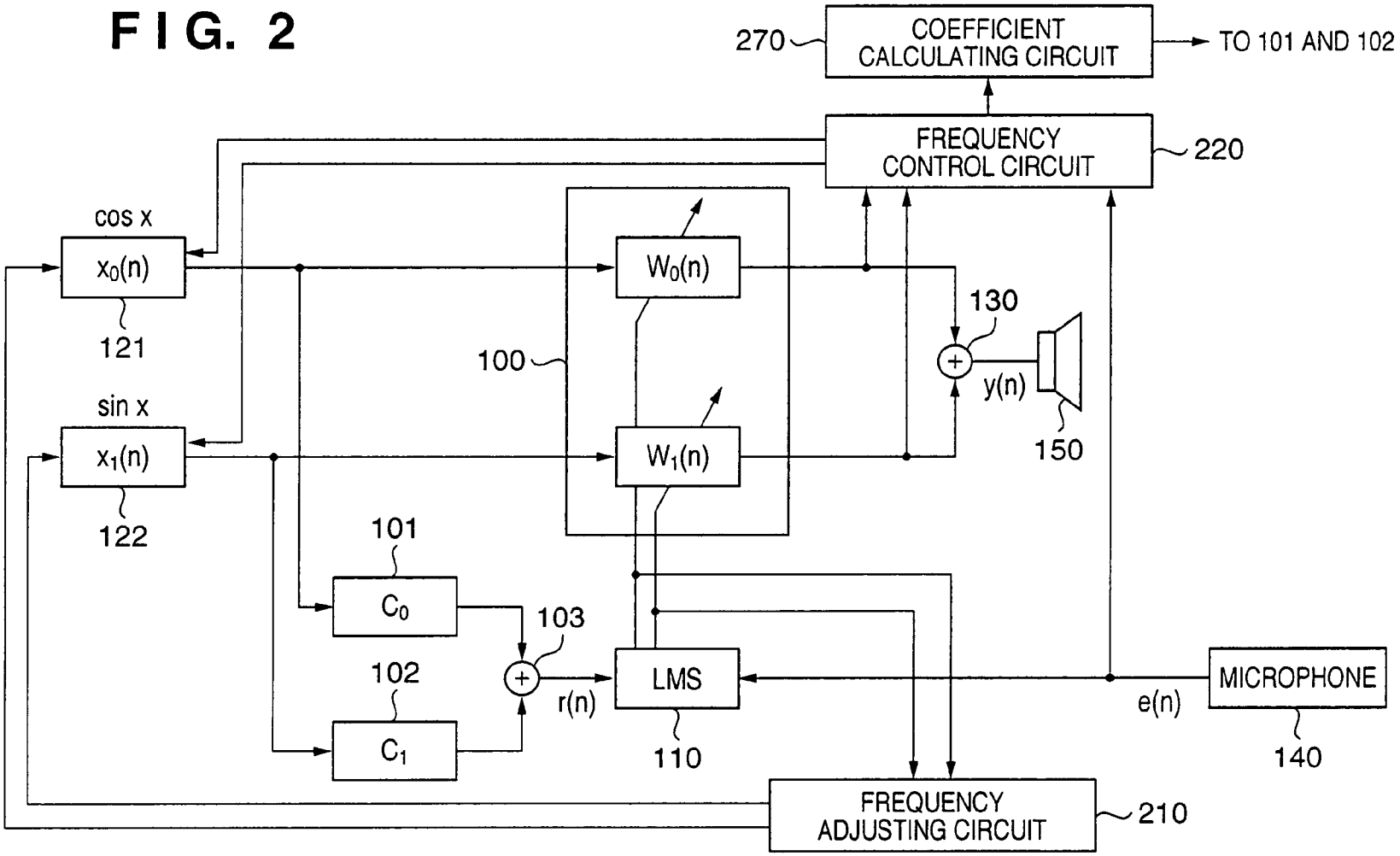
FIG. 2 is a block diagram showing an example of the arrangement of an active noise suppressor according to an embodiment of the present invention.

FIG. 2 is a block diagram showing an example of the arrangement of an active noise suppressor according to the embodiment of the present invention. The same reference numerals as in the arrangement explained in FIG. 1 denote the same components in FIG. 2, and a redundant explanation will be omitted. As is apparent from comparison of FIG. 2 with FIG. 1, the main feature of the active noise suppressor according to this embodiment is the addition of a frequency adjusting circuit 210 and frequency control circuit 220 to the conventional active noise suppressor. Accordingly, this embodiment will be explained by focusing on the arrangements and operations of these circuits. Also, a coefficient calculating circuit 270 is a circuit for calculating a coefficient representing the transfer function of a system to be registered during initialization, and is not always necessary for the arrangement of the active noise suppressor of this embodiment.

The active noise suppressor of this embodiment uses the same control sound generation principle as explained in FIG. 1. That is, a fundamental sound source including a cosine wave generator 121 and sine wave generator 122 having externally controllable output frequencies outputs a cosine wave and sine wave as fundamental waveforms having a frequency to be suppressed. An adaptive notch filter 100 multiplies the cosine wave and sine wave by filter coefficients W0 and W1, respectively, and a loudspeaker 150 installed near a noise source outputs the result of addition by an adder 130 as a control sound y.

An adaptive algorithm calculator 110 calculates the coefficients W0 and W1 of the adaptive notch filter from a reference signal r and error signal e on the basis of an adaptive control algorithm operation. The reference signal r is obtained by applying, by transfer elements 101 and 102, transfer functions C0 and C1 of a premeasured system to cosine wave and sine wave signals having a frequency f [Hz] generated from the fundamental sound source, and adding the two signals by an adder 103.

On the other hand, the error signal e is a target frequency component picked up from a microphone 140. The filter coefficients W0 and W1 are calculated from the reference signal r and error signal e on the basis of the adaptive control algorithm. When the LMS algorithm is used as the adaptive control algorithm:

Adaptive notch filter coefficients W0(n+1) and W1(n+1) at time (n+1) a predetermined unit time after certain time n are calculated by $$W0(n+1)=W0(n)+2\mu e(n)r(n)$$

$$W1(n+1)=W1(n)+2\mu e(n)r(n)$$

(where r(n) is the reference signal at n, e(n) is the error signal at n, and μ is the step size).

The frequency adjusting circuit 210 detects relatively small fluctuations in the frequency component to be suppressed, and outputs a frequency adjustment signal for allowing the output frequency of the fundamental sound source including the cosine wave generator 121 and sine wave generator 122 to track the frequency fluctuation of periodic noise.

The frequency control circuit 220 outputs a frequency control signal for setting a new output frequency of the fundamental sound source when, for example, the apparatus is first installed or the noise source has changed.

Note that in order to simplify explanation and understanding, FIG. 2 shows an arrangement for suppressing a certain frequency component of a plurality of frequency components forming noise. To suppress a plurality of frequency components, therefore, the components except for the loudspeaker 150 and microphone 140 are arranged in parallel so as to be equal in number to the frequency components to be suppressed, and the outputs from the adders 130 are further added and output from the loudspeaker 150. Note that among the components except for the loudspeaker 150 and microphone 140, a component (preprocessing block 220A) pertaining to virtual noise generation to be described later and a component (control block 220B) that detects a peak frequency by frequency analysis need not always be equal in number to the frequency components to be suppressed.

(Frequency Adjusting Circuit 210)

Figure 3:
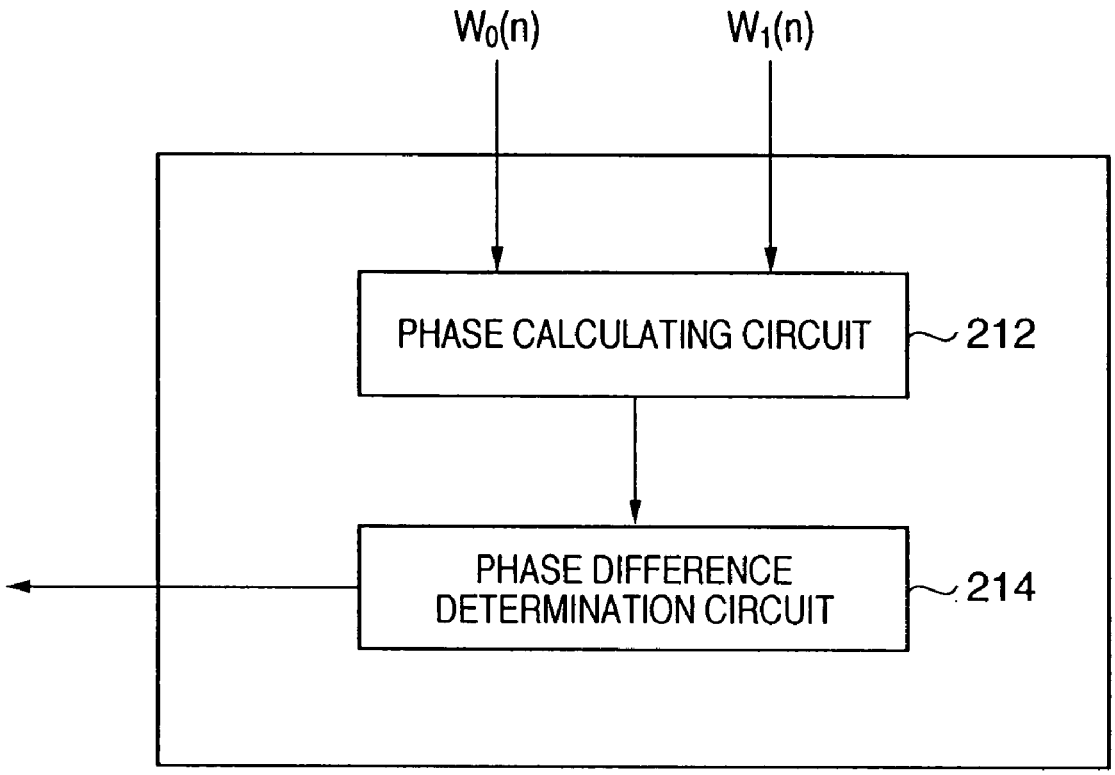
FIG. 3 is a block diagram showing an example of the arrangement of a frequency adjusting circuit 210.

FIG. 3 is a block diagram showing an example of the arrangement of the frequency adjusting circuit 210. The frequency adjusting circuit 210 has a phase calculating circuit 212, and a phase difference determination circuit 214 as a frequency adjustment signal generating means. The phase calculating circuit 212 obtains the filter coefficients W0 and W1 output from the adaptive algorithm calculator 110, and calculates a phase θ of the control sound from the filter coefficients W0 and W1.

When the control sound y having a certain frequency is expressed by y=A(cos(X+θ), the control sound y can be expressed by $$y=A\cos(X+\theta)=W0\cos(x)+W1\sin(x) \quad (1)$$

on the basis of the orthogonal transformation principle.

In equation (1), $A=\sqrt{(W0^2+W1^2)}$, and $\theta=\tan^{-1}(W1/W0)$.

On the basis of this principle, the phase calculating circuit 212 calculates the phase θ of the control sound at certain time n by $$\theta(n)=\tan^{-1}(W1(n)/W0(n))$$

and outputs the phase θ to the phase difference determination circuit 214.

The phase difference determination circuit 214 detects the change amount of the phase of the control sound from a phase θ(n−1) calculated from immediately preceding filter coefficients W0(n−1) and W1(n−1) and the phase θ(n) calculated this time, and determines whether the change amount exceeds a predetermined threshold value η; in other words, it determines whether $$|\theta(n)-\theta(n-1)|>\eta \quad (2)$$

If equation (2) is not satisfied, the phase difference determination circuit 214 determines that the phase difference falls within the error range, and outputs no frequency adjustment signal. Accordingly, no frequency adjustment is performed on the fundamental sound source. On the other hand, if equation (2) is met, the phase difference determination circuit 214 increases or decreases the output frequency of the fundamental sound source by a predetermined adjusting width σ [Hz] in accordance with whether θ(n) or θ(n−1) is larger; in other words, in accordance with the phase changing direction.

More specifically, the phase difference determination circuit 214 outputs the frequency adjustment signal to the cosine wave generator 121 and sine wave generator 122 such that If θ(n)−θ(n−1)>0 (if the phase leads)

$$f(n+1)=f(n)+\sigma$$

If θ(n)−θ(n−1)<0 (if the phase lags behind)

$$f(n+1)=f(n)-\sigma$$

This frequency adjustment process performed by the frequency adjusting circuit 210 as described above makes it possible to accurately track the fluctuation in frequency to be suppressed, particularly, a steady frequency fluctuation having a relatively small fluctuation amount per unit time. Note that the calculations of the frequency adjustment process in this embodiment are simple as described above, so the process can be performed at a high speed, for example, at a frequency of a few thousand times/sec.

(Frequency Control Circuit 220)

The frequency control circuit 220 sets a frequency when, for example, the frequency fluctuation is relatively large or the apparatus is first installed. While the frequency adjusting circuit 210 increases or decreases the adjusting width σ on the basis of the frequency at a certain time, the frequency control circuit 220 sets the output frequency itself.

Figure 4:
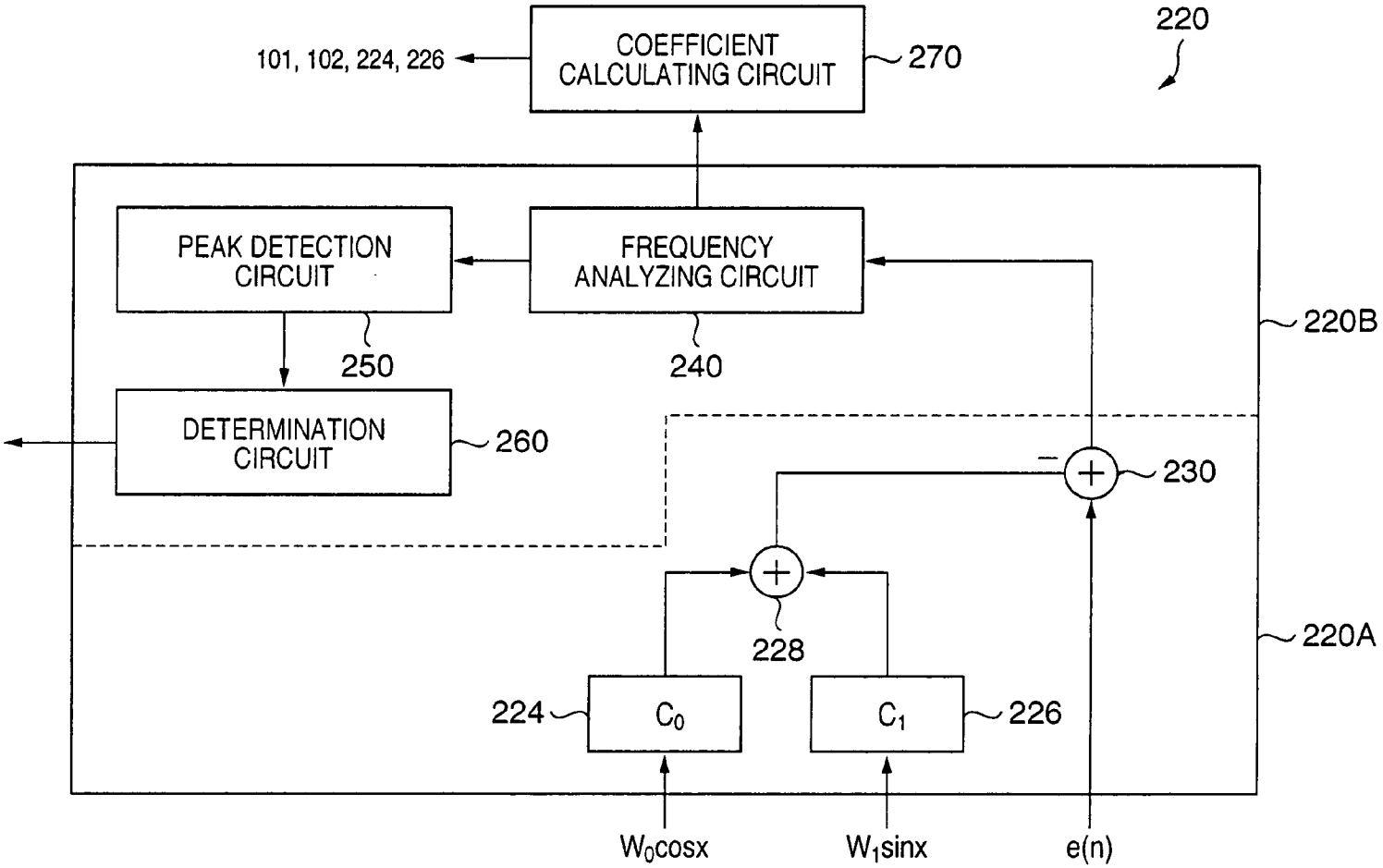
FIG. 4 is a block diagram showing an example of the arrangement of a frequency control circuit 220.

FIG. 4 is a block diagram showing an example of the arrangement of the frequency control circuit 220 in this embodiment. The frequency control circuit 220 can be roughly divided into the preprocessing block 220A that generates virtual noise, and the control block 220B that detects the peak frequency component to be suppressed from the virtual noise and sets the frequency of the fundamental sound source.

The preprocessing block 220A is a block for generating noise when the active noise suppressor is not in operation. A signal obtained from the microphone 140 when the active noise suppressor is in operation is the error signal e, and it has a frequency spectrum different from that of the original noise. To detect the peak frequency component of noise while the active noise suppressor is in operation, therefore, it is necessary to generate a signal (virtual noise) corresponding to noise when the active noise suppressor is not in operation.

The preprocessing block 220A has transfer elements 224 and 226 equivalent to the transfer elements 101 and 102, an adder 228 that adds the outputs from the transfer elements 224 and 226, and a subtracter 230 that subtracts the output signal of the adder 228 from the error signal obtained from the microphone 140.

The output signal from the adder 228 represents the control sound y (=A cos(x+θ)) obtained when W0 cos(x) and W1 sin(x) as the components of the control sound y have reached the microphone 140 through the system. That is, the W0 cos(x) component of the control sound y is input to the transfer element 224 to which the transfer function C0 of the system is applied, and the W1 sin(x) component of the control sound y is input to the transfer element 226 to which the transfer function C1 of the system is applied. The adder 228 adds the outputs from the transfer elements 224 and 226, thereby generating a signal in the state in which the control sound y has reached the microphone 140 through the system.

Note that each of the transfer elements 101, 102, 224, and 226 can be a multiplier that multiplies an input signal by coefficients corresponding to a plurality of discrete frequencies and a coefficient corresponding to the frequency of the fundamental sound source. If there is no coefficient having a frequency matching that of the fundamental sound source, it is possible to use a coefficient obtained by interpolation from a coefficient corresponding to another frequency. This coefficient can be obtained beforehand by outputting white noise or a signal having an individual frequency from the loudspeaker 150, and performing Fourier transform on the impulse response of a signal obtained by the microphone 140. Note that the coefficient may also be obtained by simulation if actual measurement is difficult in the apparatus installation location.

The subtractor 230 subtracts the output signal of the adder 228 from the error signal from the microphone 140. As a result, virtual noise is obtained from the subtractor 230. This uses the relationship represented by error signal=noise+control sound, and, noise=error signal−control sound The virtual noise thus obtained is input to a frequency analyzing circuit 240 in the control block 220B. The frequency analyzing circuit 240 analyzes the frequencies of the virtual noise by applying an FFT or the like. A peak detection circuit 250 detects some (e.g., one to three) peak frequencies from frequency components contained in the noise. The peak frequencies can be detected by applying arbitrary conditions; for example, they can be detected in order from the frequency having the maximum peak, or can be selected in order from the lowest frequency from frequencies having peaks larger than a predetermined value.

A determination circuit 260 compares the detected peak frequency with a peak frequency detected last, and determines whether the difference is larger than a predetermined threshold value fr. If there are a plurality of peak frequencies to be suppressed, this determination is performed for each peak frequency. If the difference is larger than the threshold value fr, the determination circuit 260 regards the newly detected peak frequency as the frequency to be suppressed, and sets and changes, by the frequency control signal, the output frequency of the cosine wave generator 121 and sine wave generator 122 forming the fundamental sound source, so as to output a signal having this frequency.

In this manner, automatic tracking is possible even if the peak frequency of noise fluctuates greatly. Note that the frequency resetting process performed by the frequency control circuit 220 herein explained need not be performed as frequently as the adjustment performed by the frequency adjusting circuit 210. On the contrary, this resetting process is preferably executed at proper intervals in order to reduce the processing load, because the process requires frequency analysis. For example, when the frequency of the adjustment process is 3,000 times per second, the resetting process can be performed at a frequency of about once per second.

(Initialization Process)

Figure 5:
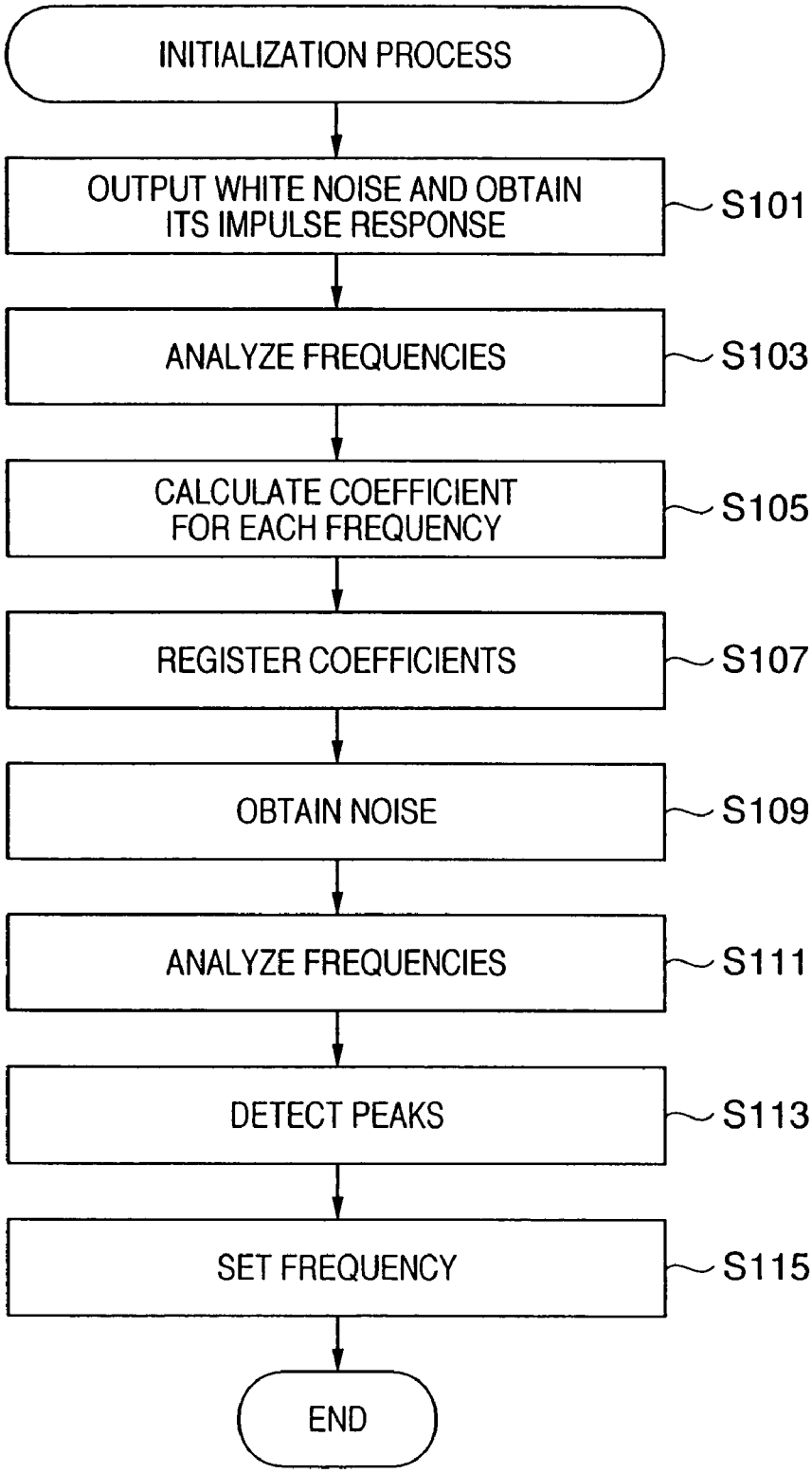
FIG. 5 is a flowchart for explaining the initialization process of the active noise suppressor according to the embodiment.

FIG. 5 is a flowchart for explaining the operation of initialization of the active noise suppressor according to this embodiment.

This process is performed before the start of operation when, for example, the apparatus is installed. First, while a noise source is not in operation, white noise is generated from the fundamental sound source or a separately prepared sound source and output from the loudspeaker 150, and the impulse response of the white noise is obtained from the microphone 140 (step S101). This noise is input as the error signal e to the frequency control circuit 220, and input to the frequency analyzing circuit 240 via the subtractor 230. In this case, neither generation nor subtraction of virtual noise is performed.

Then, the frequency analyzing circuit 240 applies an FFT to decompose the signal into information of each frequency (step S103). On the basis of the transfer characteristic of each frequency component, the coefficient calculating circuit 270 calculates coefficients corresponding to the cosine wave component and sine wave component (step S105). The calculated coefficients are registered in the transfer elements 101, 102, 224, and 226 (step S107). The foregoing is a transfer function registration process. Note that if actual measurements are difficult because, for example, it is difficult to stop the noise source, coefficients may also be registered from an impulse response obtained beforehand by simulation. Note also that this transfer function registration process may also be performed using an analyzer different from the active noise suppressor. Alternatively, the coefficient calculating circuit 270 may also be implemented by an external device.

Subsequently, a frequency setting process is performed. This process is performed while the noise source is in operation and no control sound is generated. First, noise is obtained from the microphone 140 (step S109). As in the transfer function registration process, this noise is input to the frequency analyzing circuit 240 without subtracting virtual noise. The frequency analyzing circuit 240 decomposes the noise into information of each frequency by applying an FFT (step S111).

The peak detection circuit 250 detects peak frequencies from the results of the analysis (step S113). The determination circuit 260 is then used to set a predetermined number of peak frequencies (peak frequencies equal in number to the fundamental sound sources) in the individual fundamental sound sources (step S115).

In this manner, the initialization process is completed.

(Noise Suppressing Operation)

Figure 6:
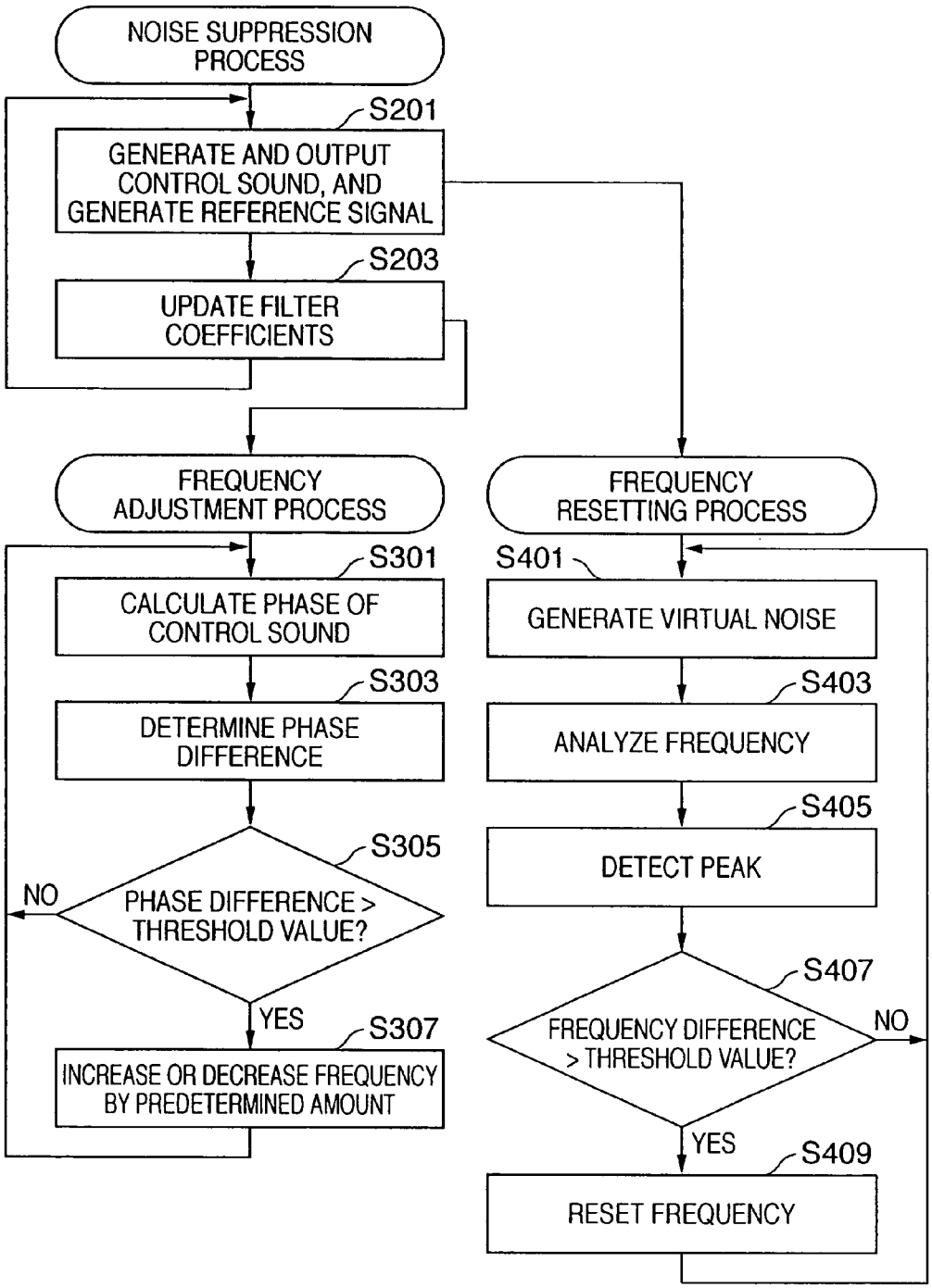
FIG. 6 is a flowchart for explaining the noise suppression process of the active noise suppressor according to the embodiment.

A noise suppression process can be executed once the initialization process is complete. This noise suppression process in the active noise suppressor of this embodiment will be explained below with reference to a flowchart shown in FIG. 6.

The basic operation is the repetition of the generation of the control sound and reference signal (step S201), and the update of coefficients of the adaptive notch filter 100 performed on the basis of the error signal and reference signal (step S203). In parallel with this basic operation, the frequency adjusting circuit 210 executes the frequency adjustment process, and the frequency control circuit 220 executes the frequency resetting process.

The frequency adjustment process is performed using the filter coefficients W0(n) and W1(n) updated in step S203 of the basic operation, and the immediately preceding filter coefficients W0(n−1) and W1(n−1).

That is, the phase calculating circuit 212 calculates the phase θ(n) of the control sound on the basis of W0(n) and W1(n) (step S301). The phase difference determination circuit 214 determines the phase difference by comparing the phase θ(n) with the phase θ(n−1) obtained from the filter coefficients W0(n−1) and W1(n−1) and stored (step S303). If the absolute value of the difference between θ(n) and θ(n−1) is less than or equal to a predetermined threshold value (N in step S305), the phase difference determination circuit 214 regards the difference as an error, and the process returns to step S301 without adjusting the frequency. On the other hand, if the phase difference is larger than the threshold value (Y in step S305), the phase difference determination circuit 214 increases or decreases the frequency by an adjusting amount in accordance with whether θ(n) or θ(n−1) is larger as described above (step S307).

The frequency resetting process is performed using the control sound generated in step S201 of the basic operation. As described above, the execution frequency of the frequency resetting process is much lower than that of the frequency adjustment process. First, the preprocessing block 220A of the frequency control circuit 220 generates virtual noise (step S401). The frequency analyzing circuit 240 of the control block 220B receives this virtual noise, and performs a frequency analyzing process (step S403). The peak detection circuit 250 detects a peak frequency from the result of the analysis (step S405). The determination circuit 260 calculates the difference between each present peak frequency and the detected peak frequency, and determines whether the difference is larger than a predetermined threshold value (step S407).

If the difference between the frequencies is less than or equal to the predetermined threshold value (N in step S407), the determination circuit 260 regards the difference as an error, and the process returns to step S401 without resetting the frequency. On the other hand, if the frequency difference is larger than the threshold value (Y in step S407), the determination circuit 260 resets the peak frequency detected in step S405 as the output frequency of the fundamental sound source (step S409).

In this embodiment as has been explained above, the active noise suppressor that suppresses noise by setting a control sound source near a noise source adjusts the output frequency on the basis of the magnitude of the phase fluctuation of a control sound. This makes it possible to accurately track the peak frequency fluctuation of noise by simple calculations, and consequently achieve a favorable noise suppressing effect.

Also, the output frequency is set by detecting the peak frequency of noise on the basis of the frequency analysis of virtual noise generated from the control sound and an error signal. This facilitates settings in the initial operation, and also facilitates control of a new environment or new noise source. It is also possible to set a new output frequency even during the noise suppression process.

EXAMPLE

A practical example of the present invention will be explained below, but the present invention is not limited to the example herein described.

An active noise suppressor having the arrangement shown in FIG. 2 was manufactured. However, transfer functions were registered by using coefficients calculated by using an apparatus different from the active noise suppressor, and the coefficient calculating circuit 270 was not formed.

Two loudspeakers were installed in a room at a height of 1.5 m from the floor and a horizontal distance of 0.6 m between them. Also, the microphone 140 was placed at a height of 1.5 m from the floor and a distance of 0.45 m in the vertical direction from the center of the two loudspeakers.

A prerecorded operating sound of a pump using a motor was played back as noise from one loudspeaker. When the initialization process (only the frequency setting process) described previously was executed, a frequency (a frequency near 145 Hz) at which a maximum peak was detected was automatically set as the initial output frequency of the fundamental sound source.

Subsequently, an error signal obtained from the microphone 140 was recorded by performing the noise suppression process. Similarly, an error signal obtained when no frequency adjustment process was performed was also recorded. The noise suppressing effect was evaluated by using the recorded noise and these error signals.

Figure 7A:
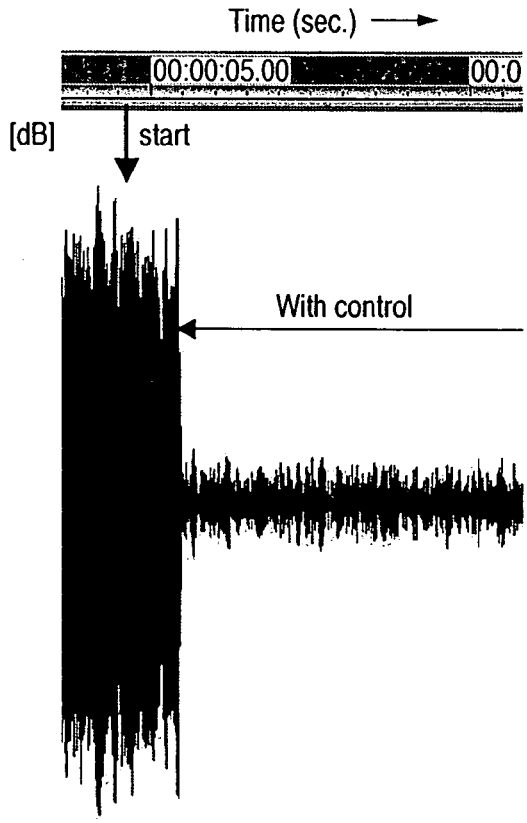
FIG. 7A is a view showing the sound pressure waveforms of error signals obtained when a frequency adjustment process was performed and when the process was not performed in the active noise suppressor according to the embodiment.
Figure 7B:
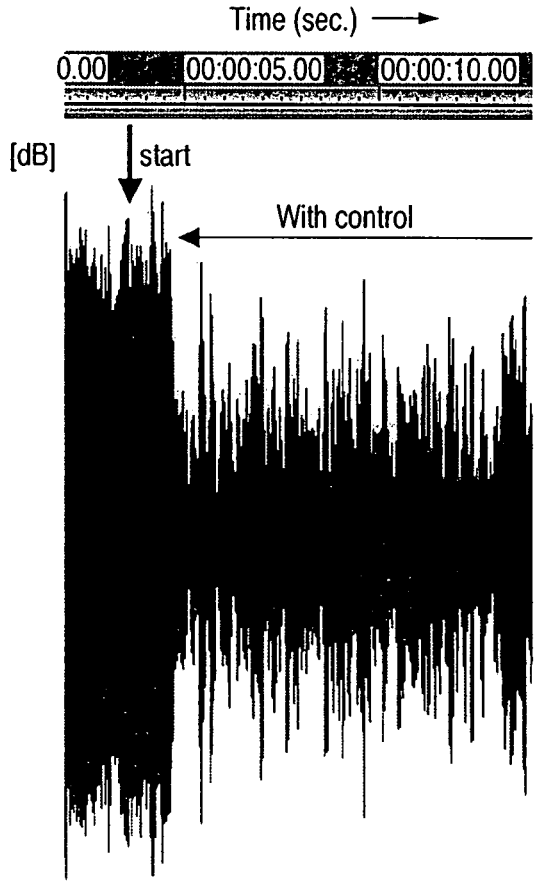
FIG. 7B is a view showing the sound pressure waveforms of error signals obtained when the frequency adjustment process was performed and when the process was not performed in the active noise suppressor according to the embodiment.

FIGS. 7A and 7B are views showing the sound pressure waveforms of the error signals when the frequency adjustment process was performed and when the process was not performed. The frequency setting process was performed from the processing start time (start), and no control sound was generated until the frequency was set, so no noise suppressing effect was obtained in either case. The suppressing effect started appearing in both the cases when the frequency setting process was complete and the generation of the control sound started. However, the noise suppressing effect in FIG. 7A showing the case that frequency adjustment was performed is obviously superior to that in FIG. 7B showing the case that no frequency adjustment was performed. This is so because the frequency adjustment process allowed the frequency to track the fluctuation in noise, and it was possible to effectively suppress frequency components except for random high-frequency components.

Figure 8A:
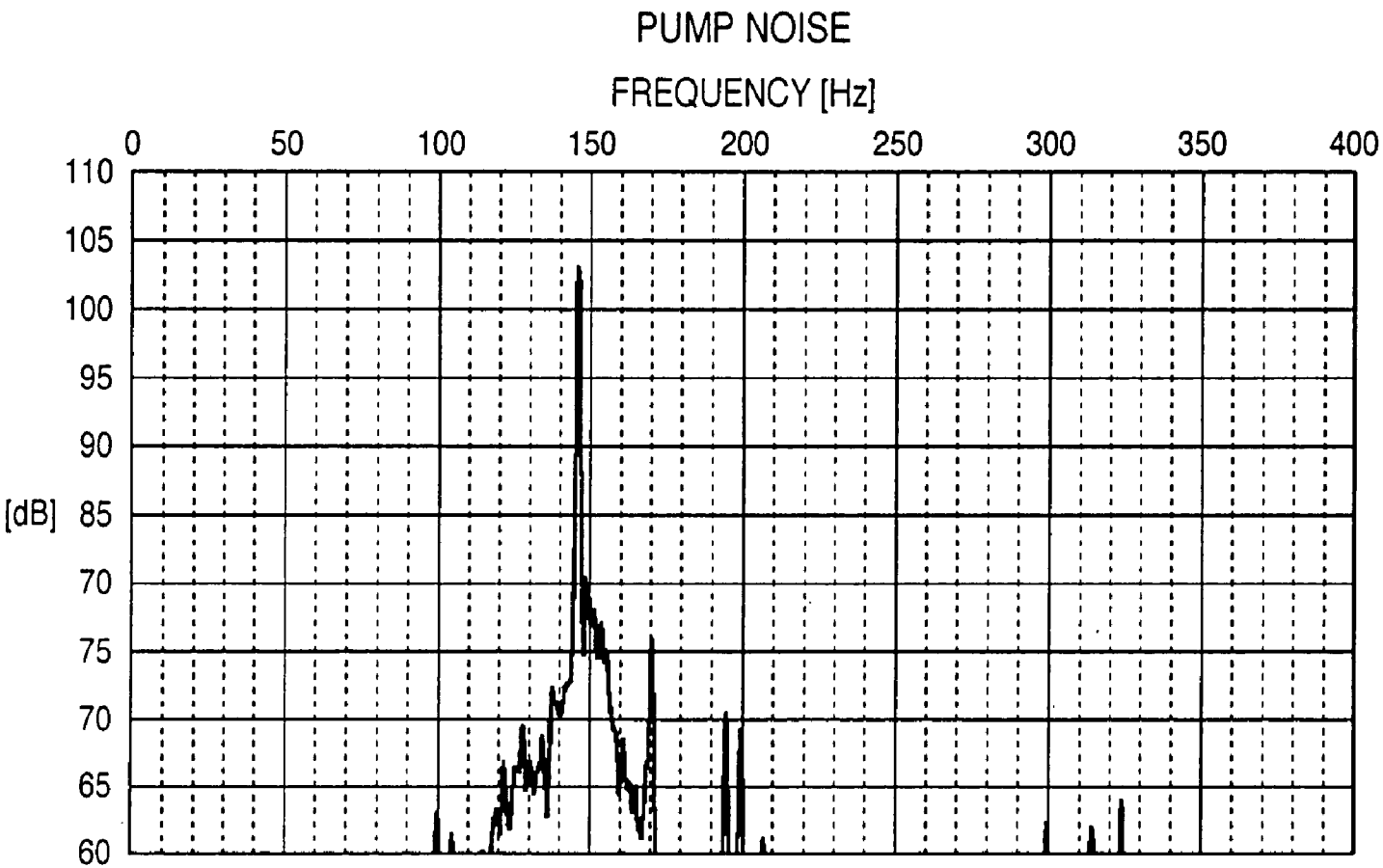
FIG. 8A is a graph showing the results of frequency analysis of noise, an error signal obtained by noise suppression with frequency adjustment, and an error signal obtained by noise suppression without frequency adjustment, at the same time during a period in which the noise suppression process was performed by generating a control sound.
Figure 8B:
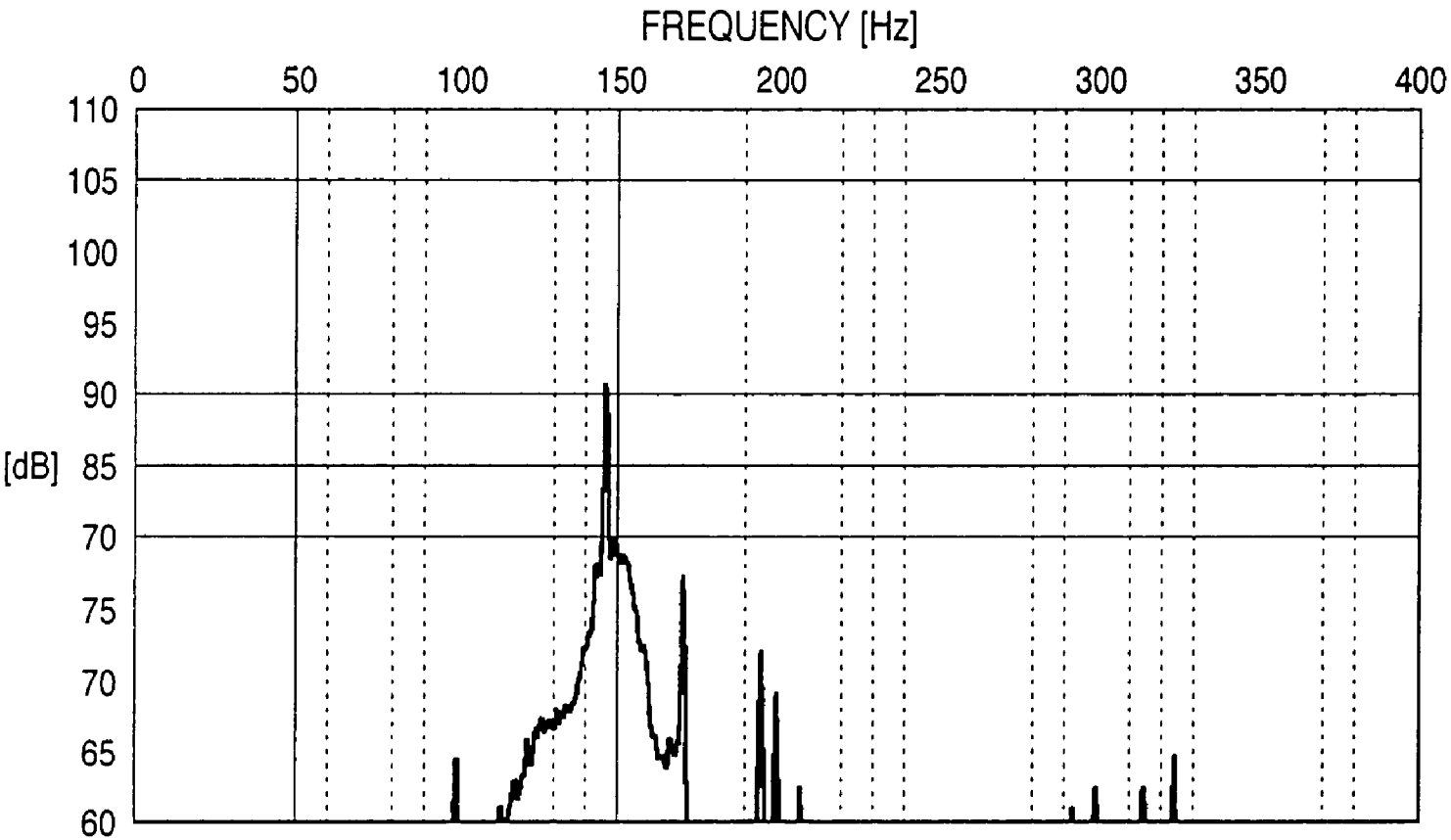
FIG. 8B is a graph showing the results of frequency analysis of noise, an error signal obtained by noise suppression with frequency adjustment, and an error signal obtained by noise suppression without frequency adjustment, at the same time during a period in which the noise suppression process was performed by generating a control sound.
Figure 8C:
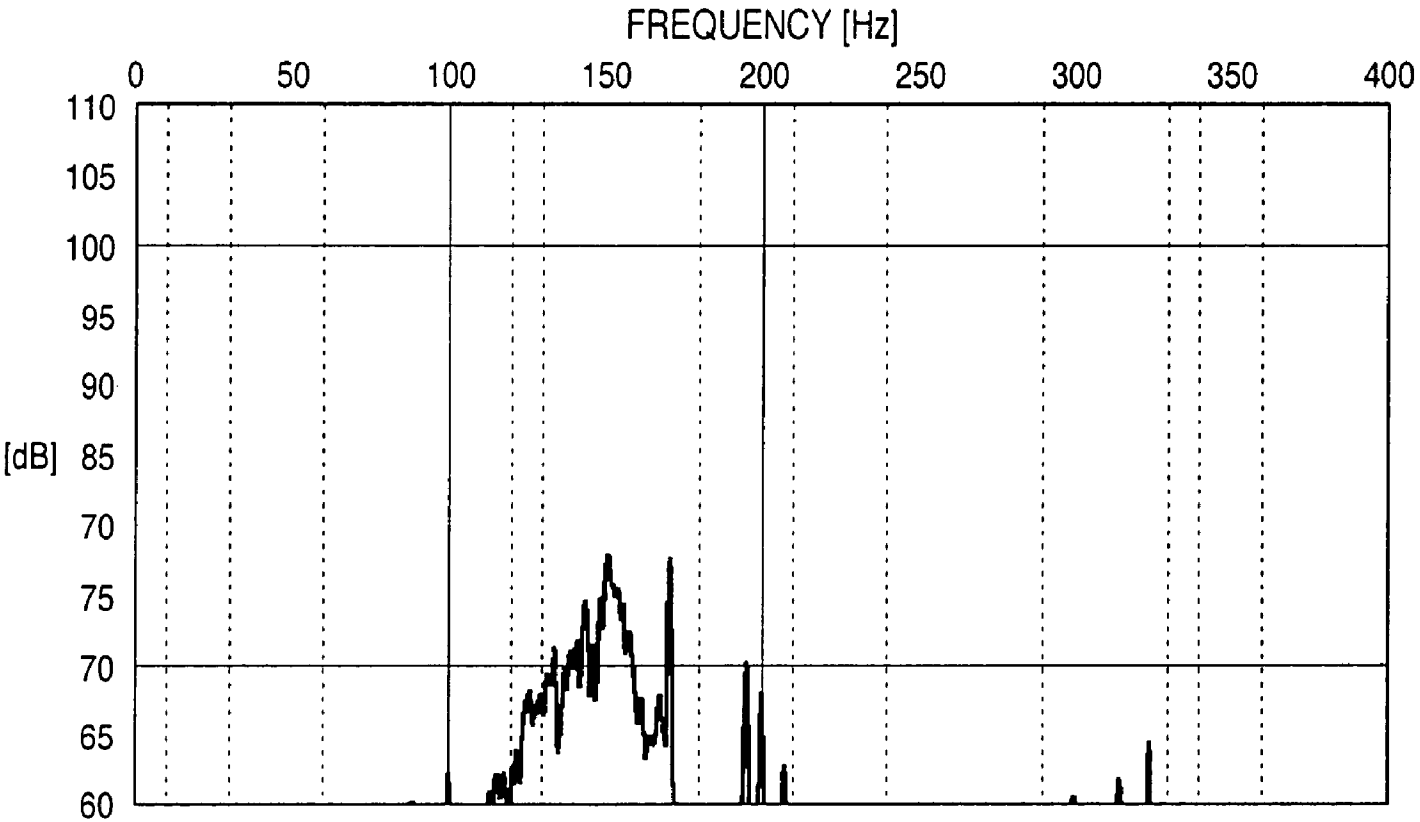
FIG. 8C is a graph showing the results of frequency analysis of noise, an error signal obtained by noise suppression with frequency adjustment, and an error signal obtained by noise suppression without frequency adjustment, at the same time during a period in which the noise suppression process was performed by generating a control sound.

Also, FIGS. 8A, 8B, and 8C are graphs respectively showing the results of frequency analysis of noise, an error signal obtained by noise suppression without frequency adjustment, and an error signal obtained by noise suppression with frequency adjustment, at the same time during a period in which the noise suppression process was performed by generating the control sound.

A comparison of FIGS. 8B and 8C reveals that the active noise suppressor of this embodiment which tracks the frequency fluctuation of noise using the frequency adjustment process effectively suppressed peak frequency components when compared to the case in which no frequency adjustment was performed.

OTHER EMBODIMENTS

The above embodiment uses the cosine wave generator and sine wave generator as the fundamental sound source, but it is also possible to use only one of these waveform generators by using a $\pi/2$ delay circuit. In this case, the $\pi/2$ delay circuit can be installed before or after the adaptive notch filter.

What is claimed is:

1. An active noise suppressor having a fundamental sound source which generates a fundamental waveform having a predetermined frequency, and suppresses a frequency component of noise which corresponds to the predetermined frequency by generating a control sound from a signal obtained by multiplying the fundamental waveform by an adaptive filter coefficient, comprising:

a phase detecting unit that detects a phase of a current control sound and a phase of a previous control sound respectively based on a current adaptive filter coefficient and a previous adaptive filter coefficient;

a change amount detecting unit that detects an amount of a phase change between the phase of the current control sound and the phase of the previous control sound; and a frequency adjusting unit that increases or decreases, by a predetermined amount, the frequency of the fundamental waveform output from said fundamental sound source, if the amount of the phase change of the control sound is larger than a predetermined threshold value.

2. An active noise suppressor according to claim 1, wherein the adaptive filter coefficient comprises a first filter coefficient and a second filter coefficient, and the control sound is represented as a synthetic waveform of a cosine wave multiplied by the first filter coefficient and a sine wave multiplied by the second filter coefficient.

3. An active noise suppressor according to claim 1, wherein said change amount detecting unit further detects a direction of the phase change of the control sound, and said frequency adjusting unit determines, in accordance with the detected direction, whether to increase or decrease the frequency of the fundamental waveform.

4. An active noise suppressor according to claim 3, further comprising:

an error signal obtaining unit that obtains, as an error signal, the frequency component of the noise after the control sound is applied;

a reference signal generating unit that generates a reference signal from the fundamental waveform and a transfer function of a premeasured system; and a filter coefficient calculating unit that calculates and updates the adaptive filter coefficient on the basis of an adaptive algorithm by using the error signal and the reference signal.

5. An active noise suppressor according to claim 4, further comprising:

a peak frequency detecting unit that detects peak frequencies of the noise; and a frequency setting unit that sets a predetermined number of peak frequencies in order from a peak frequency having a maximum peak of the detected peak frequencies, as output frequencies of said fundamental sound source.

6. An active noise suppressor according to claim 5, further comprising:

a virtual noise generating unit that generates virtual noise from the control signal, the transfer function, and the error signal;

a frequency difference detecting unit that detects a difference between a presently set peak frequency and the peak frequency detected by said peak frequency detecting unit; and a frequency resetting unit that changes, if the difference exceeds a predetermined value, the output frequency of said fundamental sound source, which generates a fundamental waveform corresponding to the presently set peak frequency, to the peak frequency detected by said peak frequency detecting unit.

7. An active noise suppressor according to claim 6, wherein said virtual noise generating unit generates, from the control sound and the transfer function of the system, a signal when the control sound has reached said error signal obtaining unit, and generates the virtual noise by subtracting the signal from the error signal.

* * * * *